US006666334B2

(12) United States Patent
Fujii

(10) Patent No.: US 6,666,334 B2
(45) Date of Patent: Dec. 23, 2003

(54) PACKING BOX

(75) Inventor: Haruhiko Fujii, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 10/106,306

(22) Filed: Mar. 26, 2002

(65) Prior Publication Data

US 2002/0139706 A1 Oct. 3, 2002

(30) Foreign Application Priority Data

Mar. 28, 2001 (JP) ..... 2001-001670

(51) Int. Cl.[7] ..... B65D 81/107; B65D 81/113

(52) U.S. Cl. ..... 206/586; 206/453; 206/592

(58) Field of Search ..... 206/453, 521, 206/523, 524, 586, 591, 592, 594; 248/345.1, 188.9

(56) References Cited

U.S. PATENT DOCUMENTS 5,522,539 A * 6/1996 Bazany ..... 229/199
5,544,806 A * 8/1996 Anderson et al. ..... 229/178
5,692,618 A * 12/1997 Beak ..... 206/586
5,823,352 A * 10/1998 Mena et al. ..... 206/721

FOREIGN PATENT DOCUMENTS

| | | |
|---|---|---|
| JP | 3-69620 | 7/1991 |
| JP | 8-198241 | 8/1996 |
| JP | 8-217056 | 8/1996 |
| JP | 11-292060 | 10/1999 |

* cited by examiner

*Primary Examiner*—David T. Fidei
(74) *Attorney, Agent, or Firm*—Rosenthal & Osha L.L.P.

(57) ABSTRACT

A packing box has a bottom surface formed double by folding flaps 11 through 14 extending downward from respective four side surfaces 1 through 4 such that mutually-opposing flaps are folded in a pair. Cushioning members 31 through 34 are individually disposed at four corners of an inner bottom of the packing box. Smaller flaps 51, 52 are formed in the flaps 11 and 12 which constitute an inner bottom surface of the double bottom surface. Notches 51*a*, 51*b*, 52*a*, and 52*b* are formed in the smaller flaps 51, 52 to come into contact with the corresponding outer shapes of the cushioning members 31, 32, 33, and 34 when the smaller flaps 51, 52 are raised. By raising the smaller flaps 51, 52, the cushioning members 31 through 34 are held between the side surfaces 1 through 4 of the box and the notches 51*a*, 51*b*, 52*a*, and 52*b*.

3 Claims, 7 Drawing Sheets

PACKING BOX

BACKGROUND OF THE INVENTION

The present invention relates to a packing box which contains an object of packing with cushioning members, such as Styrofoam, interposed between the object and the box. Particularly, the present invention relates to a packing box in which cushioning members are individually disposed at the respective internal corners of the packing box.

A packing box (hereinafter often referred to as simply a "box") which contains a commodity product, such as an electrical appliance or audiovisual equipment (hereinafter often referred to as an "object"), and is formed from, e.g., corrugated cardboard, is generally equipped with cushioning members, such as Styrofoam, paper, or rubber, to be interposed between the object and the box for preventing direct transmission of physical impact to the object, which would otherwise arise during transportation.

FIG. 9 shows a related-art packing box equipped with such cushioning members. FIG. 9 is a perspective view of a packing box, showing the inside of the box in perspective. Cushioning members 31, 33, each being formed integrally so as to extend across two adjacent corners, are disposed at the bottom of a rectangular-parallelepiped packing box. Engraved sections 31*a* through 34*a* are formed in the cushioning members 31, 33 so as to fit bottom corners of an unillustrated object. The object is disposed in the packing box so as to fit the engraved sections 31*a* through 34*a*. Subsequently, unillustrated cushioning members—in which engraved sections are formed so as to fit the upper corners of the object—are disposed in upper locations within the packing box. A top of the box is then closed, thereby completing a packing operation. The bottom of the packing box is formed double by means of folding mutually-opposing flaps 11 through 14 extending from four respective side surfaces. Similarly, the top is also formed double by means of flaps 21 through 24.

In general, after having been dismantled, cushioning members are finally discarded along with a packing box. Hence, strong desire exists for curtailing usage of cushioning material, in consideration of recent environmental issues. So long as cushioning members are individually disposed at the minimum areas required for supporting an object; for example, the corners at the inner bottom or top of a packing box, use of cushioning members can be curtailed significantly. At the time of actual packing operation, an attempt must be made to stabilize the positions of cushioning members through some contrivance in order to prevent occurrence of displacement of cushioning members disposed on the inner bottom of the packing box before an object is disposed in the carton or during the course of the object being disposed in the box. According to the related-art technique, an attempt is made to stabilize the positions of the cushioning members by means of holding cushioning members, each being formed so as to extend across two adjacent internal corners of the box, with use of two mutually-opposing side surfaces of the box. If cushioning members are disposed at respective corners individually, the cushioning members cannot be held by side surfaces of the packing box, with the result that the positions of the cushioning members become unstable.

SUMMARY OF THE INVENTION

The present invention is conceived to solve the problem and aims at providing a packing box in which cushioning members are individually disposed at respective internal corners of the box and which can stabilize the positions of the cushioning members.

In order to achieve the object, the invention provides a packing box having a shape of a rectangular parallelepiped to pack an object with a plurality of Styrofoam members, the packing box including: flaps extending from respective four side surfaces to be folded in a manner that mutually-opposing flaps are folded in a pair to form a bottom surface and a top surface to be double, the flaps constituting an inner bottom surface of the double bottom surface, smaller flaps with notches, formed in the flaps, four Styrofoam members disposed at four corners of an inner bottom of the packing box, the Styrofoam being interposed between the object and the bottom surface or the top surface, the notches coming into contact with outer shapes of the four Styrofoam members, when the smaller flaps are raised; and the Styrofoam members being sandwiched between the side surfaces of the packing box and the notches by means of raising the smaller flaps, flaps constituting an inner top of the double top, four Styrofoam members disposed at four corners of an inner top positions of the packing box having the object therein, smaller flaps formed in the flaps for limiting movement of the Styrofoam members in one horizontal direction, wherein the at least one of the four Styrofoam members have a penetration oriented in the one horizontal direction along an outer shape of the object, and a protuberance is provided on the Styrofoam member for limiting restoring actions of the raised smaller flaps.

The invention also provides a packing box with a prismatic shape which has a polygonal bottom surface to pack an object, the packing box comprising: cushioning members interposed between the object and the packing box, which are disposed at corners of an inner bottom of the packing box; smaller flaps formed in the bottom surface of the packing box; and notches formed in the smaller flaps, the notches coming into contact with outer shapes of the cushioning members when the smaller flaps are raised, wherein the cushioning members are sandwiched between side surfaces of the packing box and the notches by means of raising the smaller flaps.

For example, in view of reservation of strength of a bottom surface of a packing box, the bottom surface of the packing box is preferably multilayered, and the smaller flaps are preferably formed in the innermost bottom surface of the multilayered bottom. Further, in order to inhibit an increase in the number of parts constituting the packing box, the multilayered bottom is formed by means of folding flaps extending from the side surfaces of the box.

The invention also provides a packing box with a prismatic shape which has a polygonal bottom surface to pack an object, the packing box comprising: cushioning members to be interposed between the object and the packing box, which are disposed at upper corners of the packing box having the object therein, each of the cushioning members having a penetration oriented toward one horizontal direction along an outer shape of the object, smaller flaps formed in a top of the packing box for limiting movement of the cushioning members in the one horizontal direction; and a protuberance provided on each of the cushioning members for limiting restoring actions of the smaller flaps.

For example, in view of reservation of strength of a top of a packing box, the top of the packing box is preferably multilayered, and the smaller flaps are preferably formed in the innermost top of the multilayered top. Further, in order to inhibit an increase in the number of parts constituting the packing box, the multilayered top is formed by means of folding flaps extending from side surfaces of the box. In addition, in consideration of ease of manufacture of a cushioning member, the cushioning members preferably correspond to Styrofoam.

DETAILED DESCRIPTION OF THE PREFERRED EMBODIMENTS

Figure 1:
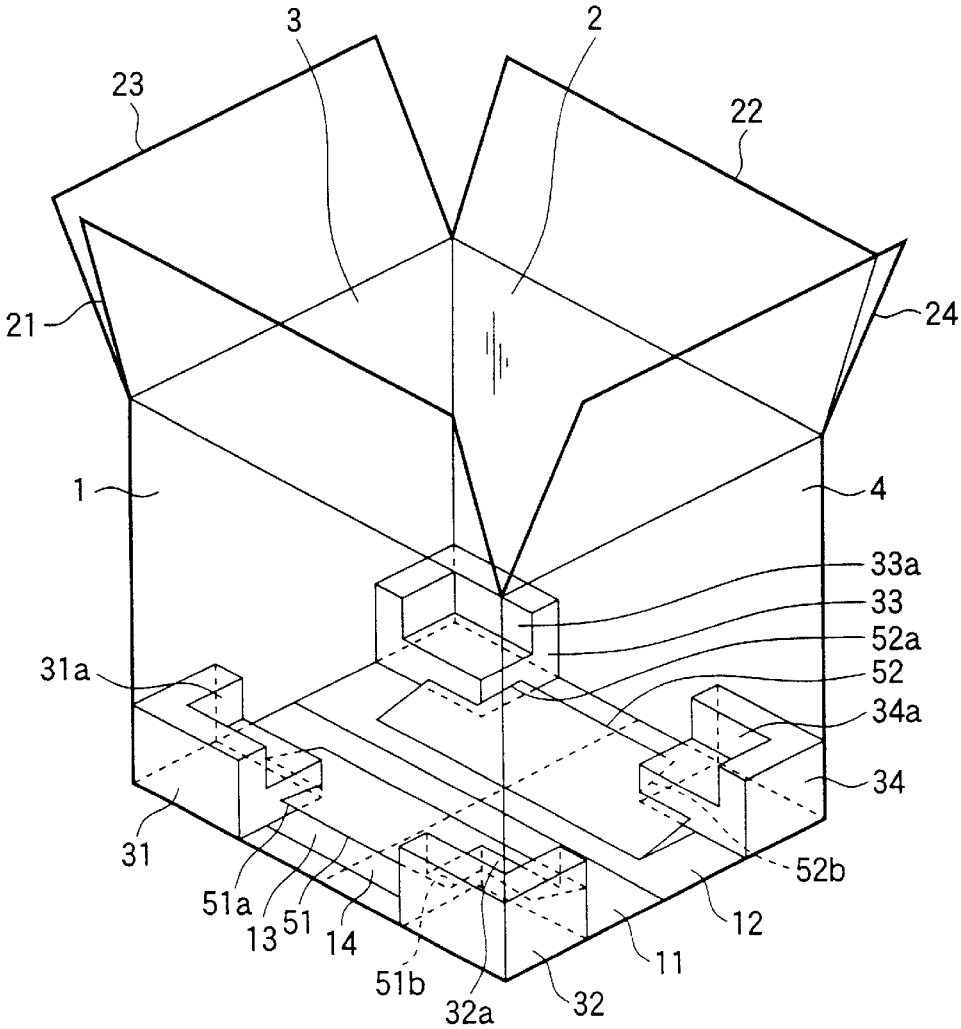
FIG. 1 is a perspective view of a packing box according to a first embodiment of the invention.

Embodiments of the present invention will be described hereinbelow by reference to the accompanying drawings. FIG. 1 shows a packing box according to a first embodiment of the invention. FIG. 1 is a perspective view of the packing box, showing the inside of the box in perspective. The packing box comprises four side surfaces 1 through 4; flaps 11 through 14 extending downward from the respective side surfaces 1 through 4; and flaps 21 through 24 extending upward from the respective side surfaces 1 through 4. The packing box has the shape of a rectangular parallelepiped. A bottom surface is formed double by means of folding a pair of mutually-opposing flaps: that is, flaps 11 and 12, and flaps 13 and 14. Further, a top is formed double by means of folding a pair of mutually-opposing flaps: that is, flaps 21 and 22, and flaps 23 and 24). Cushioning members 31 through 34 are individually disposed at four corners of the bottom of the packing box. Engraved sections 31*a* through 34*a* are formed in the cushioning members 31 through 34 so as to fit bottom corners of an unillustrated object. Here, in consideration of ease of manufacture and weight reduction, Styrofoam is applied to the cushioning members 31 through 34. A smaller flap 51 is formed in the flap 11, and another smaller flap 52 is formed in the flap 12, wherein the flaps 11 and 12 constitute an inner bottom surface of the double bottom surface. Notches 51*a* and 51*b* are formed in the smaller flap 51 so as to come into contact with the outer shapes of the cushioning members 31 and 32 when the smaller flap 51 is raised. Similarly, notches 52*a* and 52*b* are formed in the smaller flap 52 so as to come into contact with the outer shapes of the cushioning members 33 and 34 when the smaller flap 52 is raised.

Figure 2:
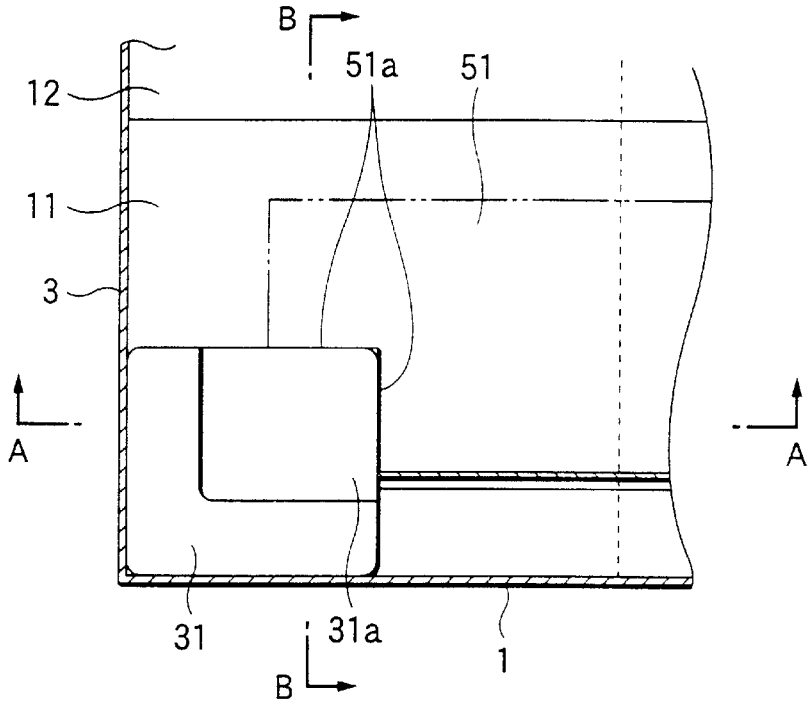
FIG. 2 is a view of part of the packing box according to the first embodiment when viewed from top.
Figure 3:
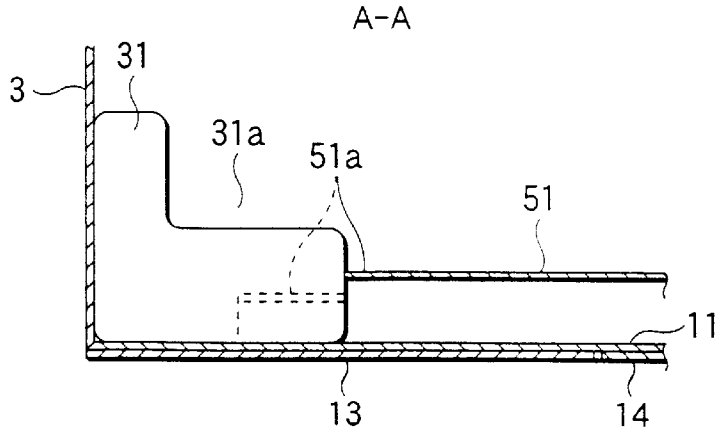
FIG. 3 is a cross-sectional view taken along line A—A shown in FIG. 2.
Figure 4:
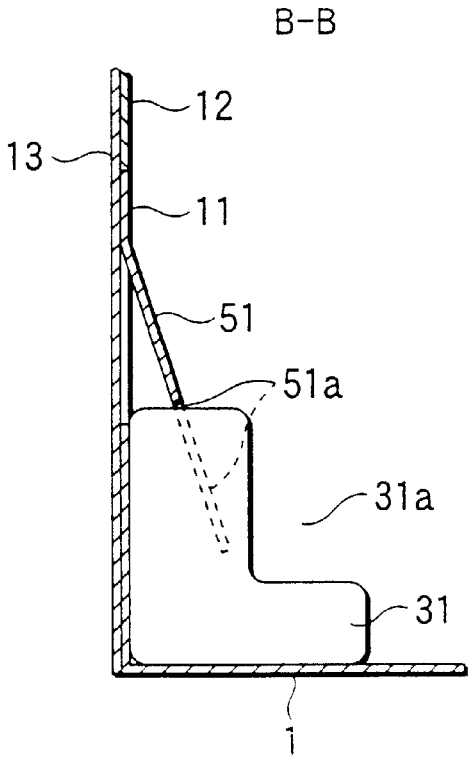
FIG. 4 is a cross-sectional view taken along line B—B shown in FIG. 2.

FIGS. 2, 3, and 4 show the state of the cushioning members 31 through 34 in the box when the smaller flaps 51 and 52 are raised. FIG. 3 is a view of the inner bottom of the box in which the cushioning member 31 is disposed when the smaller flap 51 is raised, when viewed from top. FIG. 3 is a cross-sectional view taken along line A—A provided in FIG. 2, and FIG. 4 is a cross-sectional view taken along line B—B provided in FIG. 2. The remaining cushioning members 32 through 34 which are mirror images of the cushioning member 31 are omitted from the drawings. Here, the cushioning member 31 is held by the notch 51*a* formed in the smaller flap 51, the side surface 1 of the box, and the side surface 3 of the box. In this state, the position of the cushioning member 32 is stable. Even when the box is lifted and tilted, the cushioning member 31 does not deviate from its original position. Similarly, the cushioning member 32 is held by the notch 51*b* formed in the smaller flap 51 and the side surfaces 1 and 4 of the box. The cushioning member 33 is held by the notch 52*a* formed in the smaller flap 52 and the side surfaces 2 and 3 of the box. The cushioning member 34 is held by the notch 52*b* formed in the smaller flap 52 and the side surfaces 2 and 4 of the box. These cushioning members remain stable in their positions.

Turning back to FIG. 1, a packing operation is completed through the following steps. Namely, an unillustrated object is disposed in the box so as to fit into the engraved sections 31*a* through 34*a* formed in the cushioning members 31 through 34. Subsequently, unillustrated cushioning members in which engraved sections are formed so as to fit upper corners of the object are disposed in upper positions in the box. Then, the flaps 21 through 24 constituting a top are folded, thereby closing the box.

In the first embodiment, the bottom surface is formed by means of the flaps 11, 12, 13, and 14 extending from the side surfaces 1 through 4. However, a separate bottom surface may be attached to the bottom of the box. Although the bottom surface is formed double, the same advantageous result can be yielded even when the bottom surface is formed single or from a plurality of layers. In terms of reservation of strength of the bottom surface of a packing box and a decrease in the number of parts constituting the box, the first embodiment is preferable. Although movement of two cushioning members is inhibited by means of one smaller flap, a smaller individual flap may be provided to each cushioning member.

A packing box according to a second embodiment of the invention will now be described by reference to the accompanying drawings. The second embodiment is characterized in that cushioning members are disposed in upper positions in the box after an object of packing has been disposed in the box. The technique described in connection with the first embodiment or the related-art technique may be employed until the object is disposed in the box.

Figure 5:
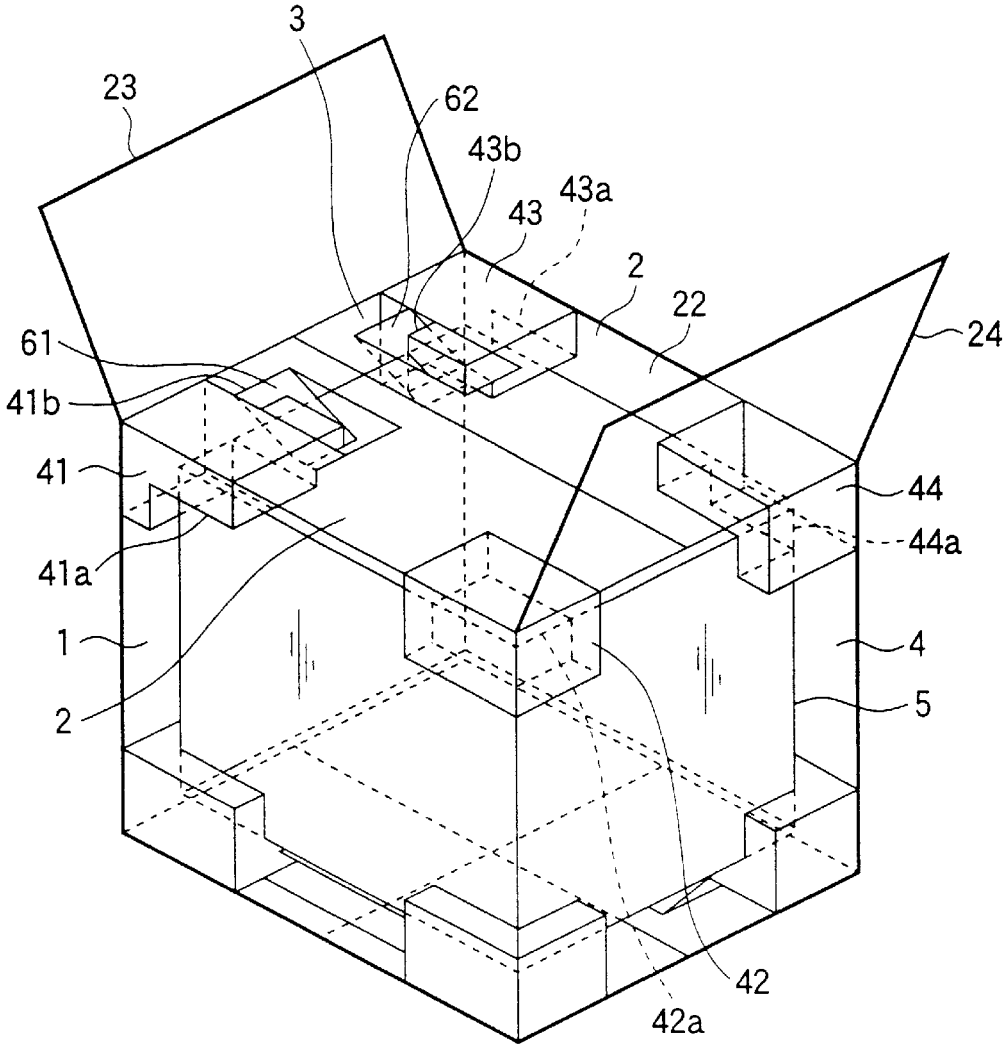
FIG. 5 is a perspective view of a packing box according to a second embodiment of the invention.

FIG. 5 is a perspective view of the packing box according to the second embodiment, showing the inside of the box in perspective. Those designations which are the same as those shown in FIG. 1 are assigned the same reference numerals, and repeated explanations thereof are omitted. Atop of the packing box is formed double by means of folding pairs of mutually-opposing flaps (i.e., flaps 21 and 22, and flaps 23 and 24) of flaps 21 through 24 extending upward from the four side surfaces 1 through 4. An object 5 is disposed in an inner bottom of the box with cushioning members interposed between the object and the bottom. Cushioning members 41 through 44 are disposed in upper four corners of the box. Engraved sections 41*a* through 44*a* are formed in the respective cushioning members 41 through 44 so as to fit upper corners of the object 5. Horizontal penetrations oriented toward the side surfaces 1, 2 of the box are provided in the engraved sections 41*a*, 43*a* of the cushioning members 41, 43 from among the engraved sections for the purpose of weight reduction. The cushioning members 41, 43 can move horizontally unless restrictions are imposed on the cushioning members. The cushioning members 42, 44 are fitted to the corresponding engraved sections 42*a*, 44*a*, and movement of the cushioning members 42, 44 is regulated by the side surfaces 1, 2, and 4 of the box. Here, in consideration of ease of manufacture and weight reduction, Styrofoam is applied to the cushioning members 41 through 44.

A smaller flap 61 is formed in the flap 21, and another smaller flap 62 is formed in the flap 22, wherein the flaps 21 and 22 constitute an inner top of the double top. When the packing box is closed by means of folding the flaps 21 and 22, the smaller flaps 61, 62 are raised so as to come into contact with ends of the cushioning members 41, 43. A protuberance 41*b* is provided on the cushioning member 41, and a protuberance 43*b* is provided on the cushioning member 43. When the smaller flap 61 attempts to return to its original position, the protuberance 41*b* interferes with the returning action of the smaller flap 61. Further, when the smaller flap 62 attempts to return to its original position, the protuberance 43*b* interferes with the returning action of the smaller flap 62.

Figure 6:
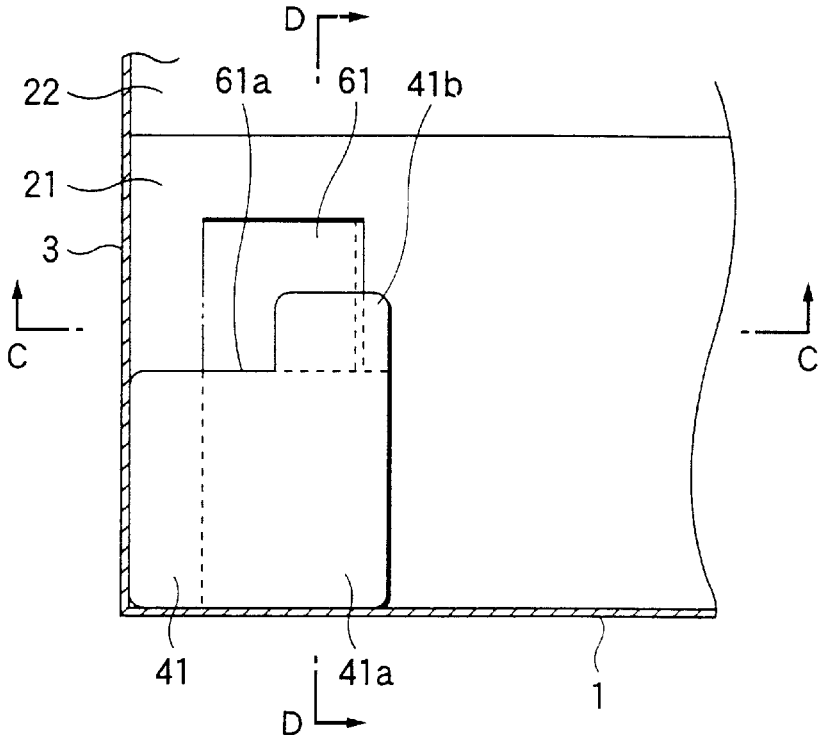
FIG. 6 is a view of part of the packing box according to the second embodiment when viewed from top.
Figure 7:
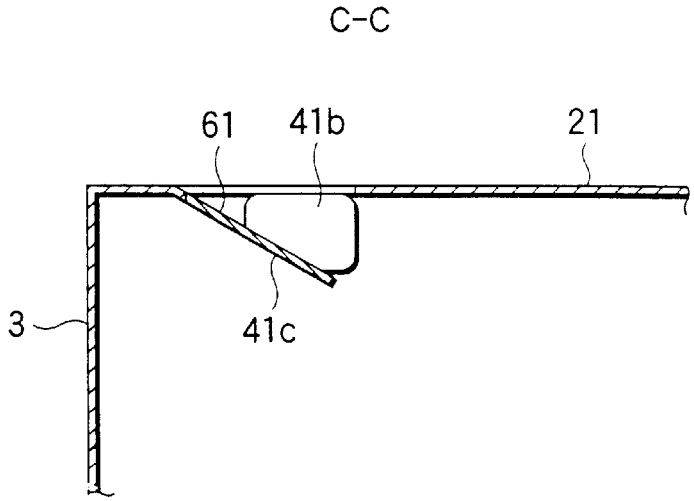
FIG. 7 is a cross-sectional view taken along line C—C shown in FIG. 6.
Figure 8:
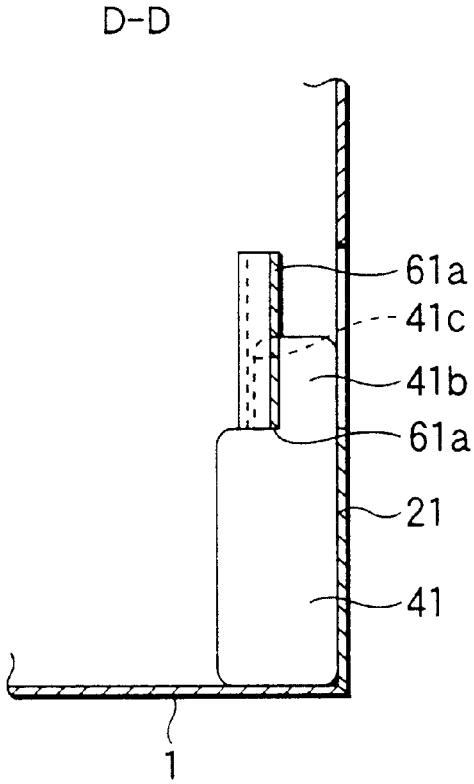
FIG. 8 is a cross-sectional view taken along line D—D shown in FIG. 6.
Figure 9:
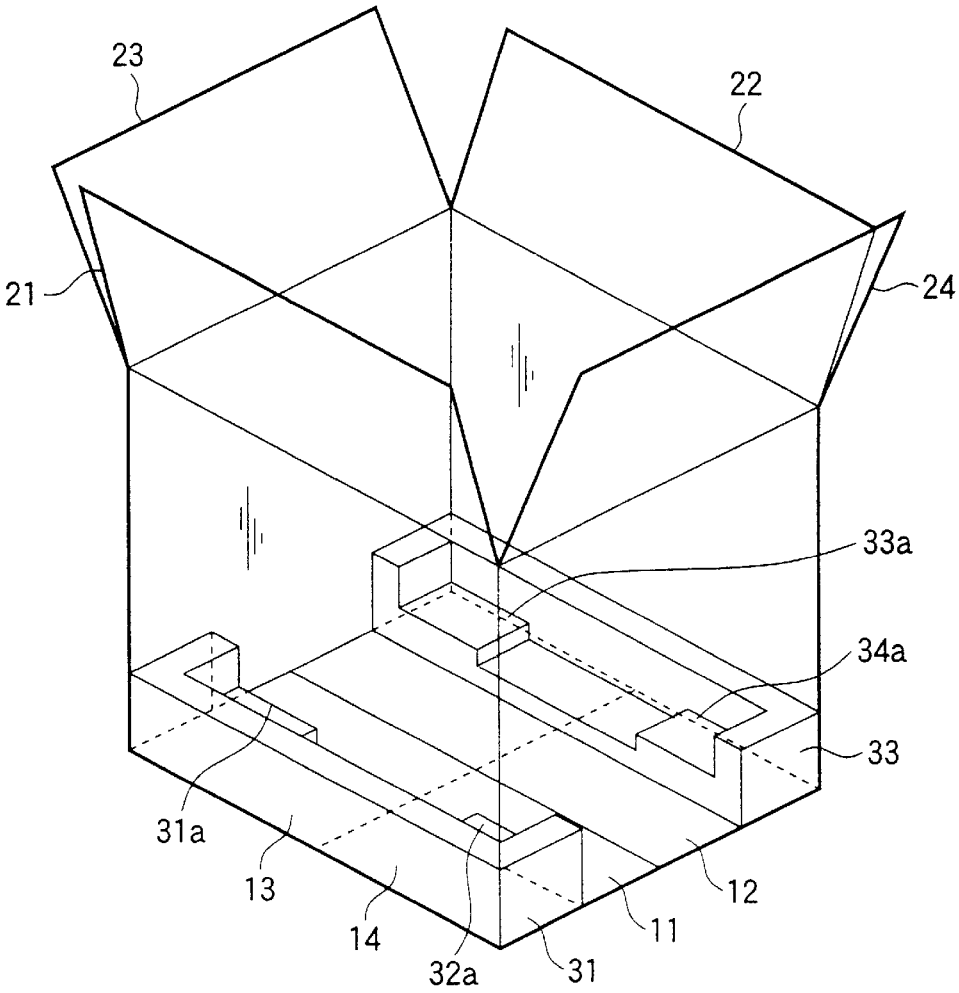
FIG. 9 is a perspective view of a related-art packing box.

FIGS. 6, 7, and 8 show the state of the cushioning members 41, 43 in the box when the smaller flaps 61 and 62 are raised. FIG. 6 is a view of the inner upper portion of the box in which the cushioning member 41 is disposed when the smaller flap 61 is raised, when viewed from top. FIG. 7 is a cross-sectional view taken along line C—C provided in FIG. 6, and FIG. 4 is a cross-sectional view taken along line D—D provided in FIG. 6. The cushioning member 43 which is a mirror image of the cushioning member 41 are omitted from the drawings. Here, movement of the cushioning member 41 is held by one end 61*a* of the smaller flap 61, the side surface 1 of the box. Returning action of the raised smaller flap 61 is hindered as a result of the smaller flap 61 coming into contact with a lower surface 41*c* of the protuberance 41*b*. The same also applies to the cushioning member 43 and the smaller flap 62. Accordingly, after the packing action has been completed by means of folding further the flaps 23, 24, the positions of the cushioning members 41, 42 become stable in this state. Even if an attempt is made to raise or tilt the packing box, the cushioning members will not deviate from their positions.

Although in the second embodiment the top is formed by means of the flaps 21, 22, 23, and 24 extending from the side surfaces, a separate member may be attached to the bottom of the box. Although the top is formed double, the same advantageous result can be yielded even when the top is formed single or from a plurality of layers. In terms of reservation of strength of the bottom surface of a packing box and a decrease in the number of parts constituting the box, the second embodiment is preferable.

Although the packing box has the shape of a rectangular parallelepiped in both first and second embodiments, cushioning members can be stably disposed in the box in the same manner as mentioned previously even if the box assumes a prismatic shape having a polygonal bottom surface.

As has been described previously, according to the invention, smaller flaps formed in the bottom or top of a packing box are raised, thereby interfering with movement of cushioning members disposed separately at corners of the box and thus rendering the positions of the cushioning members stable. Accordingly, at the time of actual packing operation, even if a packing box is raised or tilted before an object is disposed in the box or during the course of the object being placing in the box, the cushioning members will not deviate from their positions, thereby improving packing efficiency. The same also applies to a packing box in which an object has been inserted. Hence, there is assured prevention of collapse of objects, which would otherwise arise during transportation. Further, use of cushioning members can be curtailed significantly when compared to use of cushioning members in the art. Hence, manufacturing costs can be cut. Moreover, even in terms of an environmental issue, the present invention is preferable.

What is claimed is:

1. A packing box with a prismatic shape which has a polygonal bottom surface to pack an object, said packing box comprising:

cushioning members to be interposed between the object and said packing box, which are disposed at upper corners of said packing box having the object therein, each of said cushioning members having a penetration oriented toward one horizontal direction along an outer shape of the object, smaller flaps formed in a top of said packing box for limiting movement of said cushioning members in the one horizontal direction; and a protuberance provided on each of said cushioning members for limiting restoring actions of said smaller flaps.

2. The packing box according to claim 1, wherein the top of said packing box is multilayered, and said smaller flaps are formed in the innermost top of the multilayered top.

3. The packing box according to claim 2, wherein the multilayered top is formed by means of folding flaps extending from side surfaces of said packing box.

* * * * *